United States Patent [19]

Marks

[11] Patent Number: 4,895,538

[45] Date of Patent: Jan. 23, 1990

[54] SKI ROPE HANDLE AND METHOD OF ASSEMBLY

[76] Inventor: Ron Marks, 7 Hafey, Kenthurst, New South Wales 2154, Australia

[21] Appl. No.: 208,454

[22] Filed: Jun. 20, 1988

[51] Int. Cl.[4] ..... A63C 15/06

[52] U.S. Cl. ..... 441/69

[58] Field of Search ..... 441/69; 114/253; D21/230; 272/61, 143; 16/111 R, 125

[56] References Cited

U.S. PATENT DOCUMENTS

| | | | |
|---|---|---|---|
| D. 258,228 | 3/1981 | Rumbaugh | D21/230 |
| 3,304,902 | 2/1967 | Byrne et al. | 441/69 |
| 3,695,210 | 10/1972 | Stein | 441/69 |
| 3,930,460 | 1/1976 | Beck | 441/69 |
| 4,043,290 | 8/1977 | Holland | 441/69 |
| 4,060,049 | 11/1977 | Rumbaugh | 441/69 |
| 4,235,182 | 11/1980 | Burger | 441/69 |
| 4,335,478 | 6/1982 | Pittman | 441/69 |
| 4,374,638 | 2/1983 | Presser | 441/69 |
| 4,392,833 | 7/1983 | Hayden | 441/69 |
| 4,533,334 | 8/1985 | Ziomek | 441/69 |
| 4,585,420 | 4/1986 | Taylor | 441/69 |

*Primary Examiner*—Joseph F. Peters, Jr.
*Assistant Examiner*—Jesus D. Sotelo
*Attorney, Agent, or Firm*—Charles D. Gunter, Jr.

[57] ABSTRACT

A ski rope handle is shown which includes an elongate bar having opposing ends. An attachment bracket is mounted on each end of the bar at an inclined angle. Each attachment bracket has a near end joined to the elongate bar and a distant end which projects outwardly from the bar. The distant end of each attachment bracket is provided with a ski rope opening for connecting an end of the ski rope at a point remote from the elongate bar itself. The ski rope is connected to the distant end of each attachment bracket without passing through the elongate bar.

4 Claims, 1 Drawing Sheet

SKI ROPE HANDLE AND METHOD OF ASSEMBLY

BACKGROUND OF THE INVENTION

1. Field of the Invention

This invention relates generally to tow rope handles and, particularly, to a handle and tow rope arrangement adapted for use in water skiing.

2. Description of the Prior Art

In water skiing, a tow line is attached to each end of a handle. The tow line typically passes through a hole or holes in the body of the handle and then typically encircles the handle to facilitate securing the tow line to the handle. Where the tow line encircles the handle, it is usually exposed and can cause cuts and chafing to the hands of the skier as well as expose the tow line to excessive wear. A particular concern is the tearing or fraying of the ski rope adjacent to the openings formed in the ski rope handle through which the ski rope extends. One cause of this problem is the edge of the handle opening itself causing wear on the rope. Another significant cause is that the rope, in most cases, is required to bend sharply prior to entering the handle opening, thereby placing excessive stress on the rope at the point of bending against the edge of the handle opening.

A need exists for a ski rope handle assembly designed to eliminate the excessive stress caused by bending the ski rope sharply to insert the rope into the handle opening.

Another object of the invention is to provide a water ski handle and tow rope arrangement which is adapted to rest comfortably in the skier's hand to facilitate gripping and which protects the skier's hand against cutting and chafing or entanglement with the tow line.

Another object of the present invention is to achieve the preceding objects with a ski rope handle assembly which is relatively easy to manufacture and assemble and which eliminates manufacturing steps associated with handles having rope assembly points within the handle itself.

Another object of the invention is to provide a ski rope handle assembly that is durable, reliable and easy to use.

SUMMARY OF THE INVENTION

The improved ski rope handle of the invention includes an elongate bar having a central axis and opposing ends. An attachment bracket, or carrier loom, is mounted adjacent each end of the bar. Each attachment bracket has a near end connected to the elongate bar and a distant end which projects outwardly away from the bar. Each distant end is provided with an opening for receiving a ski rope, whereby the ski rope can be connected to each of the attachment brackets at a point remote from the elongate bar and without passing through the bar.

Preferably, each of the attachment brackets is inclined toward the other so that each of the attachment brackets forms an acute angle with the central axis of the elongate bar. In this way, the attachment brackets form a natural angle with respect to the converging ends of the two rope to reduce stress on the rope ends and reduce the chance of injury to the skier during use.

The attachment brackets are also displaced imwardly from the opposing ends of the elongate bar to thereby provide extended gripping regions which facilitate gripping by the skier.

Additional objects, features and advantages will be apparent in the written description which follows.

DETAILED DESCRIPTION OF THE INVENTION

Figure 1:
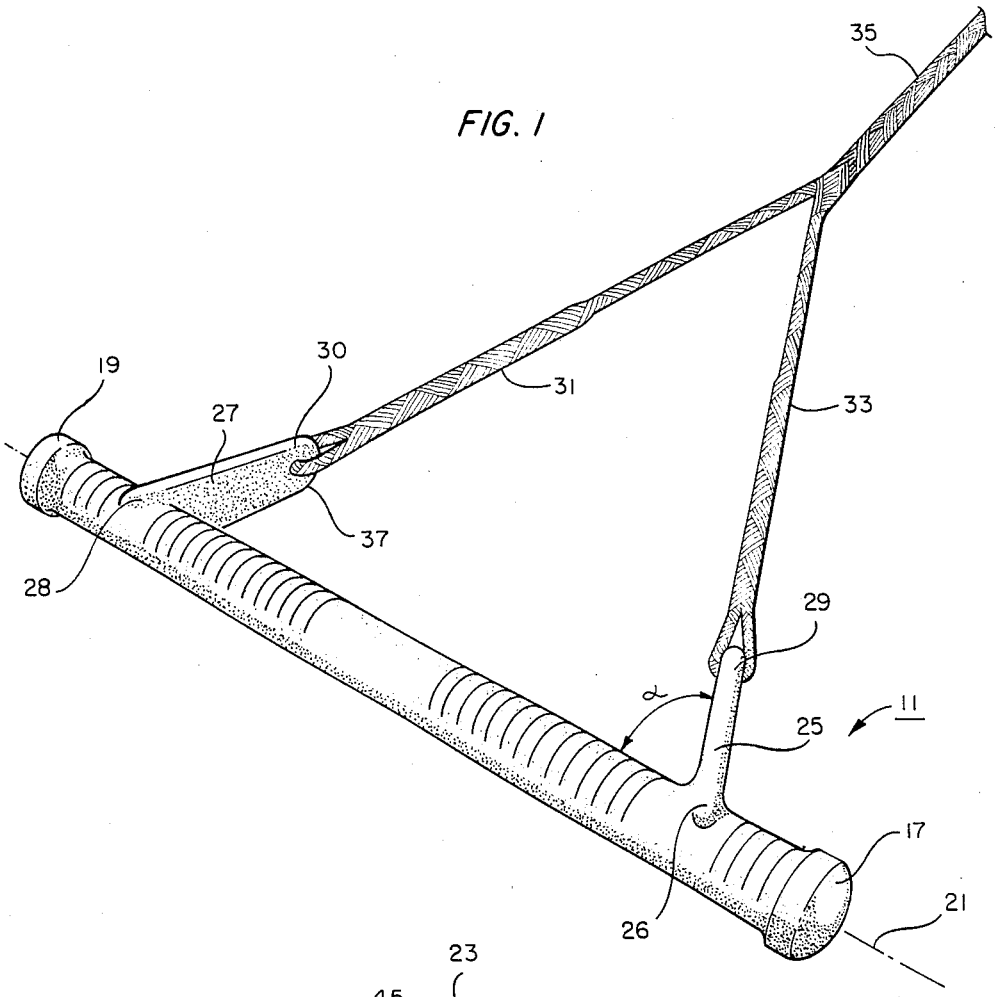
FIG. 1 is a perspective view of the improved ski rope handle of the invention with a two rope attached thereto.

FIG. 1 shows an improved ski rope handle of the invention designated generally as 11. The ski rope handle 11 comprises a metal tube 13 having an open interior 15 which communicates the opposing ends 17, 19 thereof. A central axis 21 passes through the center of the opposing ends 17, 19. The metal tube 13 is covered with an outer coating (23 in FIG. 2) of rubber or other suitable material.

Figure 2:
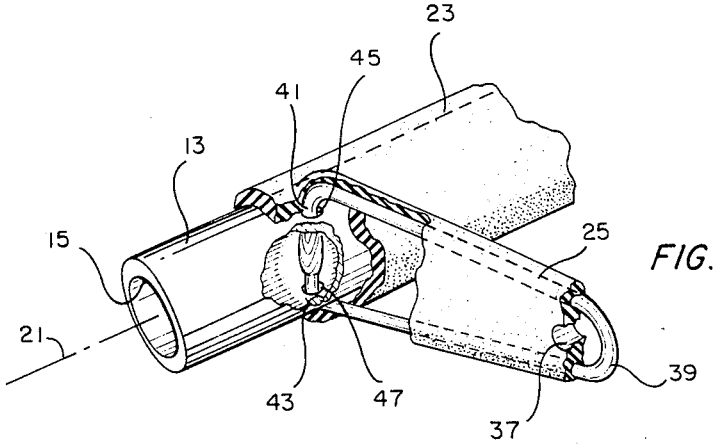
FIG. 2 is a broken-away view of one end of the ski rope handle of FIG. 1 showing the attachment bracket used to attach the ski rope.

As shown in FIG. 2, an attachment bracket 25 is mounted adjacent each end of the elongate bar 13. The attachment bracket has a near end (27 in FIG. 1) which is connected to the elongate bar and a distant end 29 which projects outwardly away from the bar. As best seen in FIG. 1, the attachment brackets 25, 27 are inclined toward one another so that each of the attachment brackets forms an acute angle alpha with respect to the central axis 21 of the elongate bar to form a natural angle with respect to the converging ends 31, 33 of the ski rope 35. Preferably the angle alpha is about 60°. Each distant end 29, 30 of the attachment brackets 25, 27 is provided with a rope opening 37 for receiving one of the converging ends 31, 33 of the ski rope 35. In this way, the ski rope 35 can be connected to each of the attachment brackets 25, 27 at a point remote from the elongate bar 13. The ski rope does not pass through the bar itself but, rather, is assembled at a point remote from the bar and from the user's hands.

As shown in FIG. 2, the attachment bracket 25 can comprise a wire carrier 39 having free ends 41, 43 which pass through vertically aligned holes 45, 47 provided in the metal tube 13. Wire carrier 39 is oblong-shaped, that is, longer than it is wide, and is preferably triangular-shaped. The free ends 41, 43 can be connected within the open interior 15, as by spot welding. The wire carriers 39 may be secured in the preselected angular positions, either through the welding process, or by molding the covering material 23 about the carriers.

Another feature of the present invention resides in the extension of the opposing ends 17, 19 from the location points (28,30 in FIG. 1) where attachment brackets 25, 27 are affixed to the elongate bar 13. In a typical ski handle, the tow rope attaches to the handle within approximately ½" of each opposing end 17, 19. In the handle of the invention, there is an extension or approximately 1½" formed between each opposing end 17, 19 and the location points 28, 30 of the attachment brackets 25, 27. By displacing the location point of the attachment brackets 27, 27 inwardly from the opposing ends 17, 19, the skier is allowed extra opportunity for grasping the handle without missing any particular maneuver, especially those concerned with tournament slalom skiing.

In the method of assembly, the elongate bar 13 is provided with attachment brackets 25, 27, as previously described. The ski rope ends 31, 33 are passed through the rope openings 37 provided in the distant ends of the attachment brackets 25, 27. The rope ends 31, 33 can then be spliced or connected back into themselves providing the finished assembly shown in FIG. 1.

An invention has been provided with several advantages. The ski rope handle of the invention provides a quick and efficient rope assembly technique which saves steps over the prior methods in which the rope passed through openings provided in the ski handle. Because the rope openings are located distant from the handle, the skier is less likely to be injured as the handle is grasped during use. Because the rope ends extend away from the handle at a more natural angle, ther is less wear upon the rope during use. Because the tow rope no longer passes through the handle, there is no wear of the tow rope against the edges of the handle openings. Because the attachment brackets project from the handle itself, the skier can grasp the elongate handle and the attachment brackets without encountering the tow rope.

The end extensions formed by the handle opposing ends 17, 19 and the location points of the attachment brackets 25, 27 provide a margin of safety for assuring proper handle grip, even during difficult maneuver such as are encountered in tournament skiing.

While the invention has been shown in only one of its forms, it is not thus limited but is susceptible to various changes and modifications without departing from the spirit thereof.

I claim:

1. An improved ski rope handle, comprising:

an elongate bar having a central axis and opposing ends;

an attachment bracket mounted adjacent each end of said bar, each attachment bracket having a near end connected to said bar and a distant end which projects outwardly away from said bar, the attachment brackets being inclined toward one another so that each of the attachment brackets forms an acute angle with the central axis of the elongate bar, each distant end being provided with an opening for receiving a ski rope, whereby the ski rope can be connected to each of said brackets at a point remote from said elongate bar and without passing through said bar, thereby providing a rope assembly point remote from the elongate bar itself; and whereby the elongate bar is of tubular construction having an open interior and wherein the attachment brackets are wire carriers having free ends, the elongate bar being provided with a hole adjacent each opposing end thereof for receiving the free ends of its respective attachment bracket.

2. The improved ski rod handle of claim 1, wherein each wire carrier is generally oblong-shaped having a pair of free ends which pass through vertically aligned holes provided in the elongate bar, the free ends of the wire carriers being joined within the open interior of the elongate bar to thereby mount the wire carrier on the bar.

3. The improved rope handle of claim 2, wherein the elongate bar and the wire carriers are covered with an integral, elastomeric coating.

4. The improved ski rope handle of claim 3, wherein the acute angle formed by each of the attachment brackets with the elongate bar is approximately 60°.

* * * * *